US010815100B1

(12) United States Patent
Westendorf et al.

(10) Patent No.: US 10,815,100 B1
(45) Date of Patent: Oct. 27, 2020

(54) GRAPPLING ASSEMBLY FOR USE WITH UTILITY EQUIPMENT

(71) Applicant: Westendorf Manufacturing Co., Inc., Onawa, IA (US)

(72) Inventors: Neal W. Westendorf, Onawa, IA (US); Daniel Keith Yarnell, Hornick, IA (US); Matthew N. Westendorf, Onawa, IA (US)

(73) Assignee: WESTENDORF MANUFACTURING CO., INC., Onawa, IA (US)

( * ) Notice: Subject to any disclaimer, the term of this patent is extended or adjusted under 35 U.S.C. 154(b) by 1321 days.

(21) Appl. No.: 14/825,359

(22) Filed: Aug. 13, 2015

Related U.S. Application Data

(63) Continuation of application No. 14/152,025, filed on Jan. 10, 2014, now abandoned.

(51) Int. Cl.
*B66C 1/42* (2006.01)

(52) U.S. Cl.
CPC ..... *B66C 1/427* (2013.01)

(58) Field of Classification Search
CPC ..... A01G 23/003; B66C 1/427; B66C 1/585; B66C 3/04; B66C 3/16; B66C 3/18; B66F 9/18; E02F 3/3622; E02F 3/3627; E02F 3/3631; E02F 3/3636; E02F 3/3663; E02F 3/404; E02F 3/4133; E02F 3/4135; E02F 3/962
See application file for complete search history.

(56) References Cited

U.S. PATENT DOCUMENTS 4,854,812 A * 8/1989 Smith ..... E02F 3/3622 414/723
8,221,049 B1 * 7/2012 Westendorf ..... E02F 3/404 294/106
2008/0115490 A1 * 5/2008 Langenfeld ..... F15B 15/1476 60/593
2009/0304486 A1 * 12/2009 Bricker ..... E02F 3/3663 414/723

* cited by examiner

*Primary Examiner* — Saul Rodriguez
*Assistant Examiner* — Brendan P Tighe
(74) *Attorney, Agent, or Firm* — The Small Patent Law Group LLC; Joseph M. Butscher

(57) ABSTRACT

A utility system may include at least one moveable arm, and at least one grappling assembly connected to the at least one moveable arm. The grappling assembly may include an upper claw including one or more lower grasping surfaces, and a lower claw including one or more upper grasping surfaces. The lower claw may be pivotally secured to the upper claw. The upper claw may be configured to close with respect to the lower claw. The lower claw may be configured to be wedged into at least a portion of the moveable arm so that the upper claw may compressively grasp a structure between the one or more lower grasping surfaces and the one or more upper grasping surfaces.

11 Claims, 17 Drawing Sheets

GRAPPLING ASSEMBLY FOR USE WITH UTILITY EQUIPMENT

CROSS-REFERENCE TO RELATED APPLICATIONS

The present application is a continuation of U.S. patent application Ser. No. 14/152,025, entitled "Grappling Assembly for Use with Utility Equipment," filed Jan. 10, 2014, which is hereby expressly incorporated by reference in its entirety.

BACKGROUND OF THE DISCLOSURE

Embodiments of the present disclosure generally relate to a grappling assembly that may be attached to a utility component, such as a front loader, backhoe, crane, boom, or the like.

Work or utility vehicles, such as tractors, skid steers, four wheelers, bulldozers, and the like, are often adapted to be used with various types of attachments. For example, loaders may be attached to the front of such equipment with arms and hydraulic controls that allow the loader to be raised and lowered, and also rolled forward and backward. Many different implements may be attached to the front of the work vehicles, thereby allowing an operator to accomplish various tasks via a single work vehicle.

Conventional front-end loaders include a pair of lifting arms or boom assemblies that include towers or rearward ends that pivotally attach to a tractor, and lifting arms or forward ends that pivotally attach to an implement A coupler may be used to connect various implements to the lifting arms. As such, the owner of a work vehicle may change the implement attached to the work vehicle in order to address the needs of a particular job. Exemplary implements found on conventional front-end loaders include buckets, clam shells, plows, fork lifts, bale spears, and the like.

Generally, the arms of the loader and the attached implement may be controlled by a hydraulic system. Hydraulic cylinders may be configured to operate front-end loaders and their attached implements. Hydraulic lines may extend along an exterior (or routed along the interior) of the front-end loaders for powering the hydraulic cylinders.

Known attachments, such as grapplers, are typically connected to a boom assembly through a complicated linkage. Further, multiple actuating cylinders are typically connected to known grapplers in order to move grappling jaws with respect to one another. For example, a first hydraulic cylinder is operatively attached to an upper jaw, while a second hydraulic cylinder is operatively attached to a lower jaw. The use of multiple actuating cylinders may add time and cost to a manufacturing process.

Further, known assemblies generally require an operator to physically connect the grappler to the boom assembly with one or more separate and distinct fasteners. As such, in order to attach and detach the grappler, the operator typically steps away from the controls of the equipment and physically handles and manipulates the grappler, the boom assembly, and the fasteners. However, during inclement weather, the operator may generally not be eager to leave the comfort of a vehicle cabin to attach or detach a grappler, for example. Further, even in mild and comfortable weather, the time of completing a task is lengthened when the operator leaves the vehicle cabin to attach or detach a grappler.

SUMMARY OF THE DISCLOSURE

Certain embodiments of the present disclosure provide a grappling assembly configured to connect to a moveable arm of a utility component. The grappling assembly may include a first or upper claw including one or more first or lower grasping surfaces, and a second or lower claw including one or more second or upper grasping surfaces. The lower claw may be pivotally secured to the upper claw. The upper claw may be configured to close with respect to the lower claw, or vice versa. The lower claw may be configured to be wedged into at least a portion of the moveable arm so that the upper claw may compressively grasp a structure between the one or more lower grasping surfaces and the one or more upper grasping surfaces. Alternatively, the upper claw may be configured to be wedged into at least a portion of the moveable arm so that the lower claw may compressively grasp a structure between the lower and upper grasping surfaces.

In at least one embodiment, the grappling assembly may be configured to connect to the moveable arm through a coupler. The grappling assembly may be configured to be removably attached to and detached from the moveable arm without the use of a separate and distinct fastener, such as a pin, bushing, or the like.

The upper claw may include a main housing defining a coupling opening and a peg-retaining member. The coupling opening may be configured to removably retain a stud of a coupler. The peg-retaining member may be configured to removably retain an actuatable connecting peg of the coupler. In at least one other embodiment, the upper claw may include a main housing having one or more latch members configured to securely latch onto reciprocal features of a coupler or a distal end of the moveable arm.

In at least one embodiment, the lower claw pivotally secures to the upper claw at a pivot axis. The grappling assembly may be devoid of any additional linkages between the upper and lower claws. The pivot axis may be configured to be substantially axially aligned with an arm pivot axis of the moveable arm or a coupler. For example, the pivot axis may be exactly aligned with the arm pivot axis, or the pivot axis may be offset within a range of distances from the arm pivot axis.

One or both of the lower and upper claws may include connecting beams that connect multiple claw members together, thereby forming a rake, fork, or basket structure. Each of the upper and lower claws may include at least one grasping tooth.

Certain embodiments of the present disclosure provide a utility system that may include at least one moveable arm, and at least one grappling assembly connected to the at least one moveable arm. The grasping assembl(ies) may be similar to the embodiments described above.

Certain embodiments of the present disclosure may provide a grappling assembly configured to connect to a moveable arm of a utility component. The grappling assembly may include an upper claw including one or more lower grasping surfaces, and a lower claw including one or more upper grasping surfaces. The lower claw may be pivotally secured to the upper claw. The upper claw is configured to close with respect to the lower claw, or vice versa. The grappling assembly is configured to be removably attached to and detached from the moveable arm without the use of a separate and distinct fastener.

Certain embodiments of the present disclosure provide a method of removably attaching a grappling assembly to a moveable arm of a utility component. The method may include attaching the grappling assembly to the moveable arm, and removing the grappling assembly from the moveable arm. The attaching operation may include (i) urging a distal end of the moveable arm into an upper claw of the grappling assembly, (ii) aligning and mating an upper connector of a coupler or a distal end of the moveable arm with an upper reciprocal member of the upper claw, (iii) aligning a lower connector of the coupler of the distal end of the moveable arm with a lower reciprocal member of the upper claw; and (iv) moving the lower connector of the coupler or the distal end of the moveable arm in the lower reciprocal member of the upper claw.

The removing operation may include (i) removing the lower connector of the coupler or the distal end of the moveable arm from the lower reciprocal member of the upper claw, (ii) swinging the grappling assembly forward about a connection between the upper connector of the coupler or the distal end of the moveable arm; (iii) urging a portion of the grappling assembly into a fixed structure; and (iv) pivoting the upper connector of the coupler or the distal end of the moveable arm off of the upper reciprocal member of the upper claw.

The method may include refraining from using a separate and distinct fastener to connect the grappling assembly to the moveable arm. The attaching and removing operations may be conducted without an individual operator physically handling any of the grappling assembly or the moveable arm.

Figure 1:
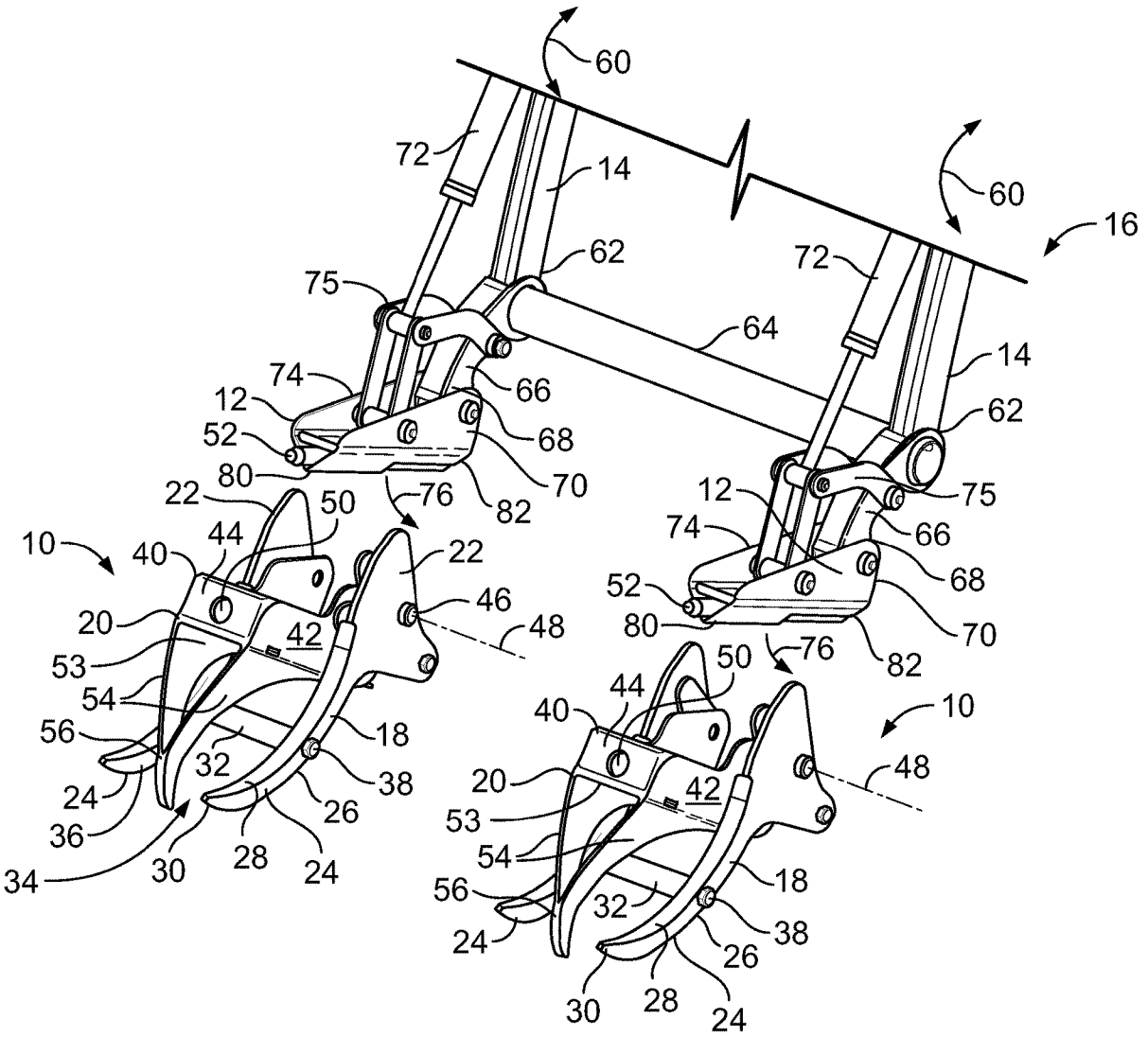
FIG. 1 illustrates two grappling assemblies aligned with couplers connected to moveable arms of a utility component, according to an embodiment of the present disclosure.

Before the embodiments are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Embodiments of the present disclosure may be used with various work or utility vehicles and/or equipment. For example, embodiments of the present disclosure may be used with respect to tractors, front loaders, backhoes, skid steers, and the like, such as described in U.S. Pat. No. 7,160,077, entitled "Grapple Assembly, A Front end Loader Having a Grapple Assembly, and Method for Operating a Grapple, Assembly," U.S. Pat. No. 7,431,554, entitled "Pinching Fingers Attachment for Utility Vehicles," U.S.

Pat. No. 7,566,197, entitled "Independent Hydraulic Pinching Fingers Attachment for Utility Vehicles," and U.S. Pat. No. 8,221,049, entitled "Independent Hydraulic Pinching Fingers with Detachable Secondary Implement," all of which are hereby incorporated by reference in their entireties.

FIG. 1 illustrates two grappling assemblies 10 aligned with couplers 12 connected to moveable arms 14 of a utility component 16, according to an embodiment of the present disclosure. The utility component 16 may be a front loader, skid steer, crane, boom, or the like, for example. In general, the utility component 16 may typically be operatively connected to a bucket or shovel for digging, transporting, or the like. The bucket may be operatively connected to the moveable arms 14. However, the bucket may be removed from the moveable arms 14, and the couplers 12 may be configured to securely connect to the grappling assemblies 10. While two grappling assemblies 10 are shown, it to be understood that more or less grappling assemblies 10 may be used. For example, embodiments of the present disclosure may provide a single grappling assembly 10, such as if used with respect to a backhoe.

Each grappling assembly 10 may include a lower claw 18 pivotally secured to an upper claw 20. The lower claw 18 may include opposed side walls 22 having arcuate teeth 24 extending therefrom. Each tooth 24 may include a curved main body 26 having an upper grasping surface 28 and a distal tip 30, which may be pointed and configured to dig into structures, such as logs, tubes, brush, and the like. The two teeth 24 may be connected together through a connecting rod 32 that spans a gap 34 between the teeth 24. The rod 32 may generally perpendicularly connect to interior surfaces 36 of the opposed teeth 24 through one or more fasteners 38, such as bolts. Alternatively, the lower claw 18 may not include the connecting rod 32

While shown with two opposed teeth 24, the lower claw 18 may include more or less than two teeth 24. For example, the lower claw 18 may alternatively include a single tooth. Moreover, it is to be understood that the terms "upper" and "lower" are merely with respect to the orientations shown in the drawings. Embodiments of the present disclosure provide grappling assemblies that may include first and second claws that are configured to pivot relative to one another. Either of the first and second claws may be above or below the other. Indeed, the first and second claws may be oriented such that they open in non-vertical orientations, such that neither claw is above or below the other. Alternatively, the first and second claw may be oriented in a perpendicular direction. For example, the first and second claws may be horizontally-oriented such that the claws are configured to close about a vertical axis. In this embodiment, neither claw may be above or below the other, but, instead, positioned with respect to a horizontal plane.

The upper claw 20 may include a main housing 40 having lateral walls 42 integrally connected to an upper wall 44 and a lower wall (hidden from view in FIG. 1). The lateral walls pivotally connect to the side walls 22 of the lower claw 18 through fasteners 46, such as bolts, that are configured to define a pivot axis 48 about which the upper claw 20 pivots with respect to the lower claw 18.

A coupling opening 50 is formed through the upper wall 44 and is configured to receive and removably retain an upwardly-extending stud 52 of a coupler 12. Grasping teeth 54 extend from a front surface 53 of the main housing 40 and may converge at distal tips 56. As such, the converged distal tips 56 may be pivoted into the gap 34 formed between the opposed teeth 24 of the lower claw 18. Alternatively, a single tooth may extend from a center of the main housing 40. Also, alternatively, parallel teeth may extend from the main housing 40 and may be configured to pivot into the gap 34. Additionally, alternatively, the upper claw 20 may include more than two teeth. Further, the teeth configurations of the lower and upper claws 18 and 20, respectively, may be switched.

As noted, the grappling assemblies 10 may be configured to removably connect to the couplers 12 connected to the moveable arms 14 of the utility component 16. The moveable arms 14 may be configured to be rotated up and down in the directions of arc 60. As shown, the two moveable arms 14 may be connected at distal portions 62 by a connecting bar 64. The moveable arms 14 may each include coupler-connecting beams 66 that may extend outwardly and downwardly from the connecting bar 64. The coupler-connecting beams 66 may be integrally formed with the moveable arms 14. Alternatively, the coupler-connecting beams 66 may be separate and distinct pieces connected and secured to the distal portions 62. Distal ends 68 of the connecting beams 66 may be pivotally connected to lower portions 70 of the couplers 12. Actuating cylinders 72 may connect to upper portions 74 of the couplers 12 through linkages 75. The actuating cylinders 72 may be hydraulic, pneumatic, and/or spring-operated, and may be configured to extend and retract with respect to the couplers 12. When the cylinders 72 extend toward the couplers 12, the couplers 12 pivot downwardly in the direction of arc 76. When the cylinders 72 retract with respect to the couplers 12, the couplers 12 pivot upwardly in the direction that is opposite that of arc 76.

Each coupler 12 includes the stud 52 at an upper end 80 and a connecting peg or plunger (not shown in FIG. 1) that may be actuated outwardly from a lower end 82. The coupler 12 may be used with respect to an actuating cylinder, such as a hydraulic or pneumatic cylinder. The coupler 12 may be further described in U.S. Pat. No. 7,559,270, entitled "Hydraulic Cylinder System," which is hereby incorporated by reference in its entirety.

As shown in FIG. 1, the upper claw 20 may be actuated through operation of the cylinder 72, while the lower claw 18 is not operatively connected to a cylinder. For example, the cylinder 72 may operatively connect to the upper claw 20 through the coupler 12. Alternatively, the configuration may be reversed such that the lower claw 18 is operatively connected to a cylinder, while the upper claw 20 is not operatively connected to a cylinder. In such embodiments, the lower claw 18 may be driven toward the upper claw 20 to grasp an object.

Figure 2:
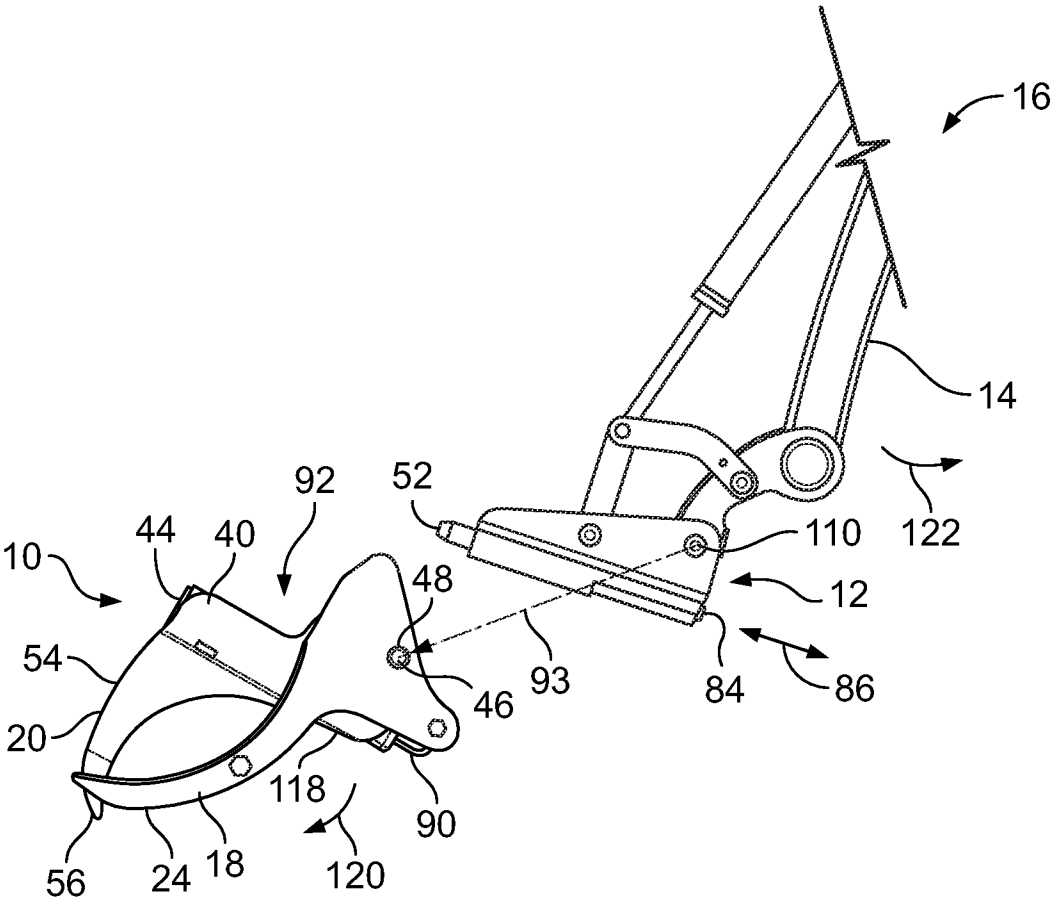
FIG. 2 illustrates a grappling assembly aligned with a coupler connected to a moveable arm of a utility component, according to an embodiment of the present disclosure.

FIG. 2 illustrates a grappling assembly 10 aligned with a coupler 12 connected to a moveable arm 14 of a utility component 16, according to an embodiment of the present disclosure. As shown in FIG. 2, the coupler 12 includes a claw-connecting peg or plunger 84 that may be configured to be moved in and out of the coupler in the directions of arrow 86. The stud 52 may be fixed and stationary, while the claw-connecting plunger 84 may be configured to be moved between retracted and extended positions, by way of an actuating cylinder, such as described in U.S. Pat. No. 7,559,270.

The grappling assembly 10 includes the lower claw 18 that pivotally connects to the upper claw 20 at the pivot axis 48. As shown in FIG. 2, the grappling assembly 10 is in a closed position, such that the distal tips 56 of the grasping teeth 54 are positioned within the gap 34 (shown in FIG. 1) defined between the teeth 24 of the lower claw 18. Notably, the lower claw 18 may connect to the upper claw 20 only at the pivot axis 48. As such, additional linking devices, components, or the like, may not be needed to pivot the lower claw 18 with respect to the upper claw 20. Instead, a clearance volume 92 is defined between main housing 40 of the upper claw 20 and the side walls 22 of the lower claw 18. The clearance volume 92 may be devoid of any additional structure, other than the fasteners 46, that would otherwise be used to mechanically connect the upper claw 20 to the lower claw 18. Instead, the fasteners 46 may define the only mechanical connecting points between the lower claw 18 and the upper claw 20. As such, the upper claw 20 may be configured to open wider than known grapplers that include additional linkages, as there is nothing within the clearance volume 92 that would otherwise block pivotal movement between the upper claw 20 and the lower claw 18.

The main housing 40 of the upper claw 20 may also include a peg-retaining member 90, such as a reciprocal housing, opening, or the like, that is configured to receive and retain the claw-connecting peg or plunger 84 of the coupler 12 when the claw-connecting plunger 84 is actuated into an extended position. In this manner, the claw-connecting plunger 84 may be retained within the peg-retaining member 90 to secure the upper claw 20 to the coupler 12, and therefore the grappling assembly 10 to the coupler 12.

Referring to FIGS. 1 and 2, in order to securely connect the grappling assembly 10 to the moveable arm 14, the moveable arm 14 is moved into the main housing 40 of the upper claw 20 in the direction of arrow 93 until the stud 52 of the coupler 12 is aligned with the opening 50 formed through the upper wall 44 and the claw-connecting plunger 84 is aligned with the peg-retaining member 90. The stud 52 is then moved into the opening 50 until it is retained therein.

Figure 3:
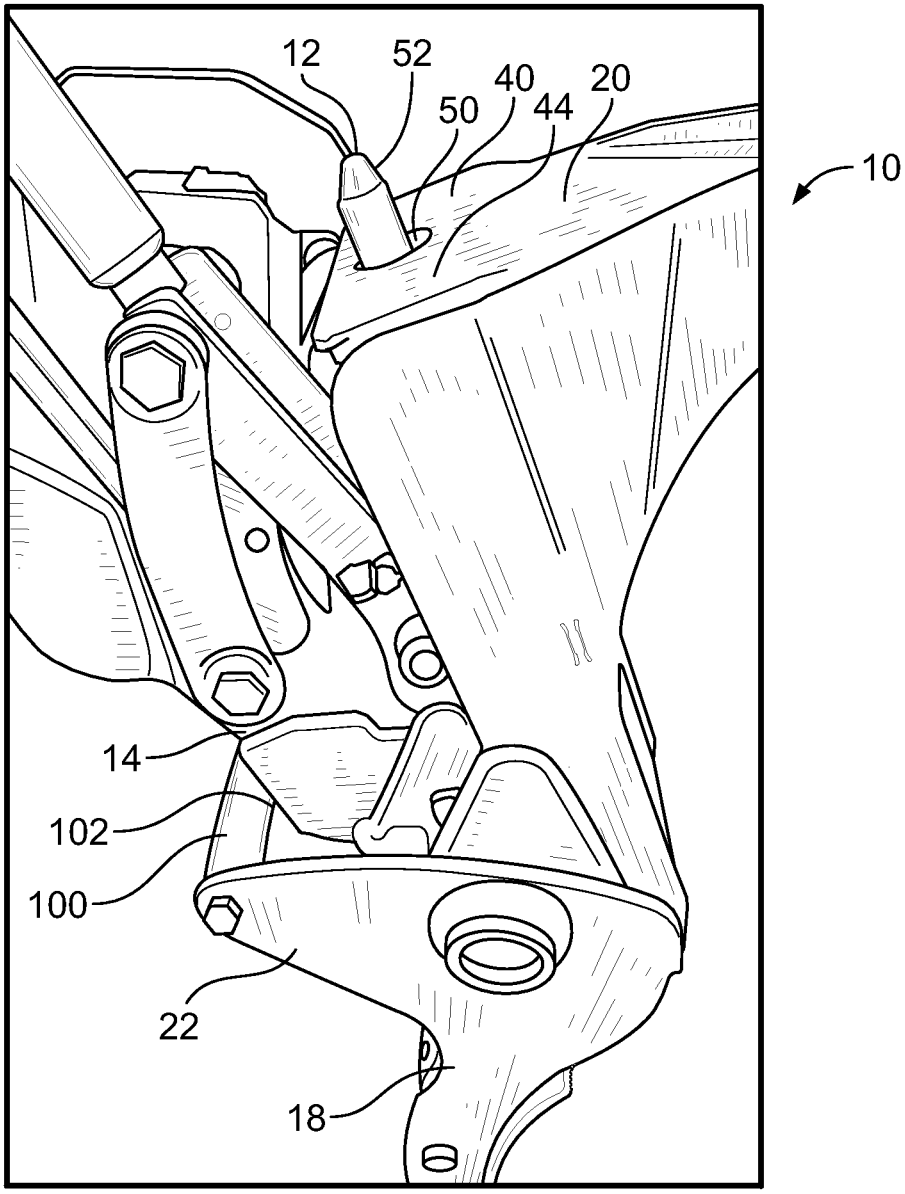
FIG. 3 illustrates a perspective lateral view of an upper claw of a grappling assembly secured to a coupler, according to an embodiment of the present disclosure.

FIG. 3 illustrates a perspective lateral view of the upper claw 20 of the grappling assembly 10 secured to the coupler 12, according to an embodiment of the present disclosure. As shown in FIG. 3, the stud 52 of the coupler 12 is positioned through the opening 50 formed through the upper wall 44 of the main housing 40 of the upper claw 20. Thus, the upper claw 20 is securely hooked onto the coupler 12.

As shown in FIG. 3, a stopping device, such as a stop bar 100, extends between lower portions of the opposed side walls 22 of the lower claw 18. The stop bar 100 is configured to abut into a lower or rear (depending on the orientation) surface 102 of the moveable arm 14 and prevent further rotation of the lower claw 18 toward the moveable arm 14. In the position shown in FIG. 3, the abutting relationship between the stop bar 100 and the moveable arm 14 allows the lower claw 18 to be restrained so that the upper claw 20 may be rotated toward the wedged lower claw 18, which provides leverage in relation to a structure being grasped between the claws 18 and 20.

Referring again to FIGS. 1 and 2, once the stud 52 is securely hooked into the opening 50 of the upper wall 44 of the main housing 40, the claw-connecting plunger 84 may be actuated out into an extended position so that the claw-connecting plunger 84 is securely retained within the peg-retaining member 90. In this manner, the upper claw 20, and therefore the grappling assembly 10, may be securely connected to the coupler 12. As such, additional fasteners and pins are not needed to connect the grappling assembly 10 to the coupler 12. Instead, an operator may simply operate the moveable arms 14 as described above in order to connect the grappling assembly 10 to the coupler 12. Accordingly, the operator may not need to physically touch any portion of the grappling assembly 10, the coupler 12, or any separate and distinct fastener with his/her hands in order to connect the grappling assembly 10 to the coupler 12.

In the connected position, the pivot axis 48 of the grappling assembly 10 may be axially aligned with respect to a lower pivot axis 110, such as where the lower portion of the coupler 12 pivotally connects to the distal end of the coupler-connecting beam 66. As such, the centers of gravity of the grappling assembly 10 and the coupler 12 and/or a distal end of the moveable arm 14 may generally be aligned with one another, thereby providing more intuitive control and operation of the grappling assembly 10.

The pivot axis 48 may not be exactly axially aligned with respect to the lower pivot axis 110. Instead, the pivot axis 48 may be generally aligned with the lower pivot axis 110 such that the pivot axis 48 may be offset with respect to the lower pivot axis 110 by a short distance, such as to account for differences in centers of gravity. For example, the pivot axis 48 may be offset 5-10 degrees forward from the pivot axis 48. However, the offset may be greater or less than 5-10 degrees. As such, the pivot axis 48 may be substantially axially aligned with respect to the lower pivot axis 110.

In order to disconnect the grappling assembly 10 from the coupler 12, the claw-connecting plunger 84 may be retracted into the coupler 12 so that the claw-connecting plunger 84 retreats and is removed from the peg-retaining member 90. As such, the center of gravity of the lower portion 118 of the main housing 40 may cause it to swing away from the coupler 12 about the connection between the stud 52 and the opening 50 so that the claw-connecting plunger 84 is no longer aligned with the peg-retaining member 90. The upper claw 20 may then be urged into the ground (not shown), which provides a leverage point. The moveable arms 14 may then be moved back in the direction of arc 122, thereby removing the stud 52 from the opening 50 due to the grappling assembly 10 being leveraged with respect to the ground.

As such, embodiments of the present disclosure provide a grappling assembly 10 that may be quickly and easily connected and disconnected from the moveable arm 14. An operator need not physically handle and manipulate any portion of the grappling assembly 10, the moveable arm 14, the coupler 12, or any separate and distinct fasteners (such as connecting pins) in order to connect and disconnect the grappling assembly 10 with respect to the moveable arm 14. Instead, the operator may remain at the controls of the utility component 16 to connect and disconnect the grappling assembly 10 with respect to the utility component 16.

Figure 4:
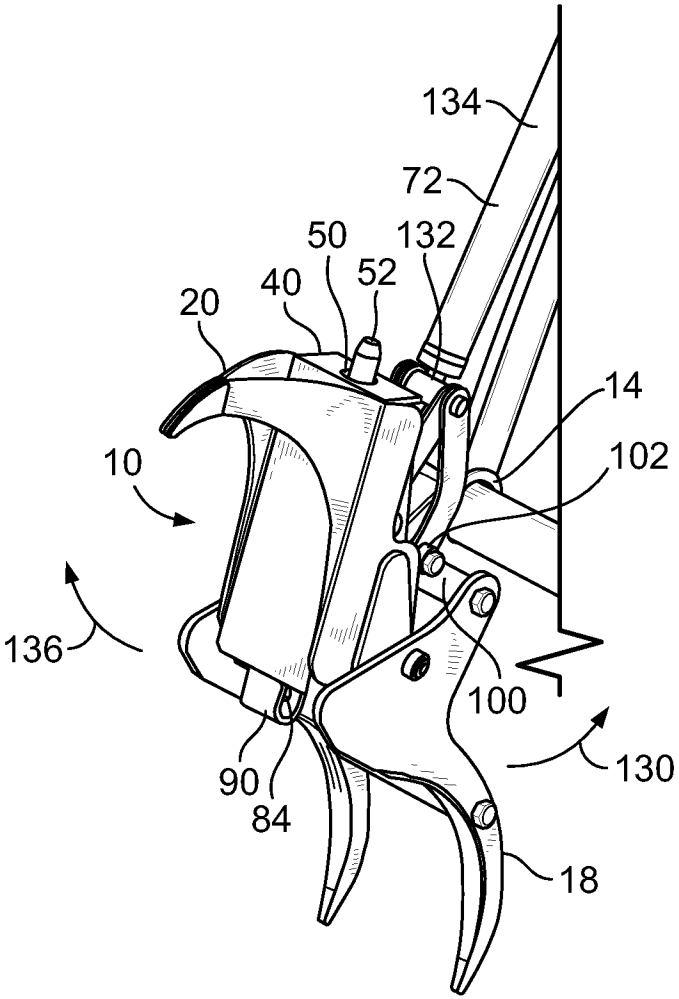
FIG. 4 illustrates a perspective top view of a grappling assembly in a fully-opened position, according to an embodiment of the present disclosure.

FIG. 4 illustrates a perspective top view of the grappling assembly 10 in a fully-opened position, according to an embodiment of the present disclosure. As shown in FIG. 4, the main housing 40 of the upper claw 20 is securely connected to the coupler 12 by way of the stud 52 being retained within the opening 50 of the upper wall 44, and the claw-connecting plunger 84 being retained within the peg-retaining member 90 that is opposite from the upper wall 44.

The stop bar 100 abuts into a rear surface 102 of the moveable arm 14, thereby preventing the lower claw 18 from opening further in the direction of arrow 130. The actuating cylinder 72 is operated to retract an extension member 132 into a cylinder housing 134 in order to draw the upper claw 20 upwardly and openly in the direction of arc 136. Notably, while the actuating cylinder 72 is operatively attached to the upper claw 20, the lower claw 18 may not be operatively connected to any actuating cylinder. Instead, the grappling assembly 10 is configured to grasp and hold structures through the use of only one actuating cylinder of a loader, for example, operatively connected to the upper claw 20, for example. As such, the grappling assembly 10 provides an efficient and cost-effective design as compared to known grapplers.

Figure 5:
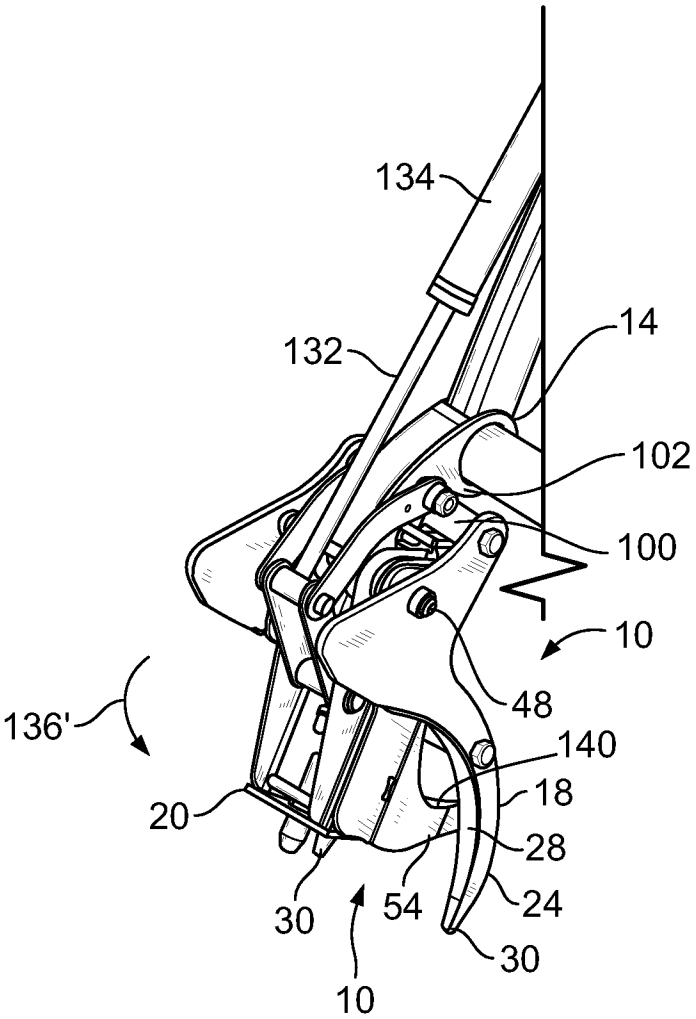
FIG. 5 illustrates a perspective top view of a grappling assembly in a closed position, according to an embodiment of the present disclosure.

FIG. 5 illustrates a perspective top view of the grappling assembly 10 in a closed position, according to an embodiment of the present disclosure. In order to close the grappling assembly 10, the lower claw 18 is wedged against the moveable arm 14, such as by the stop bar 100 being urged into the moveable arm 14. For example, the distal tip 30 of the teeth 24 of the lower claw 18 may dig into the ground, or leveraged against a structure, and the moveable arm 14 may be operated in order to move the stop bar 100 into the moveable arm 14. The extension member 132 is then actuated out of the cylinder housing 134 to pivot the upper claw 20 about the pivot axis 48 in the direction of arc 136', so that the grasping teeth 54 of the upper claw 20 are moved in the gap 34 defined between the opposed teeth 24 of the lower claw 18. As such, an item positioned between the lower claw 18 and the upper claw 20 may be compressively grasped between upper grasping surfaces 28 of the teeth 24 of the lower claw 18 and lower grasping surface(s) 140 of the grasping teeth 54 of the upper claw 20.

Figures 6, 7, 8:
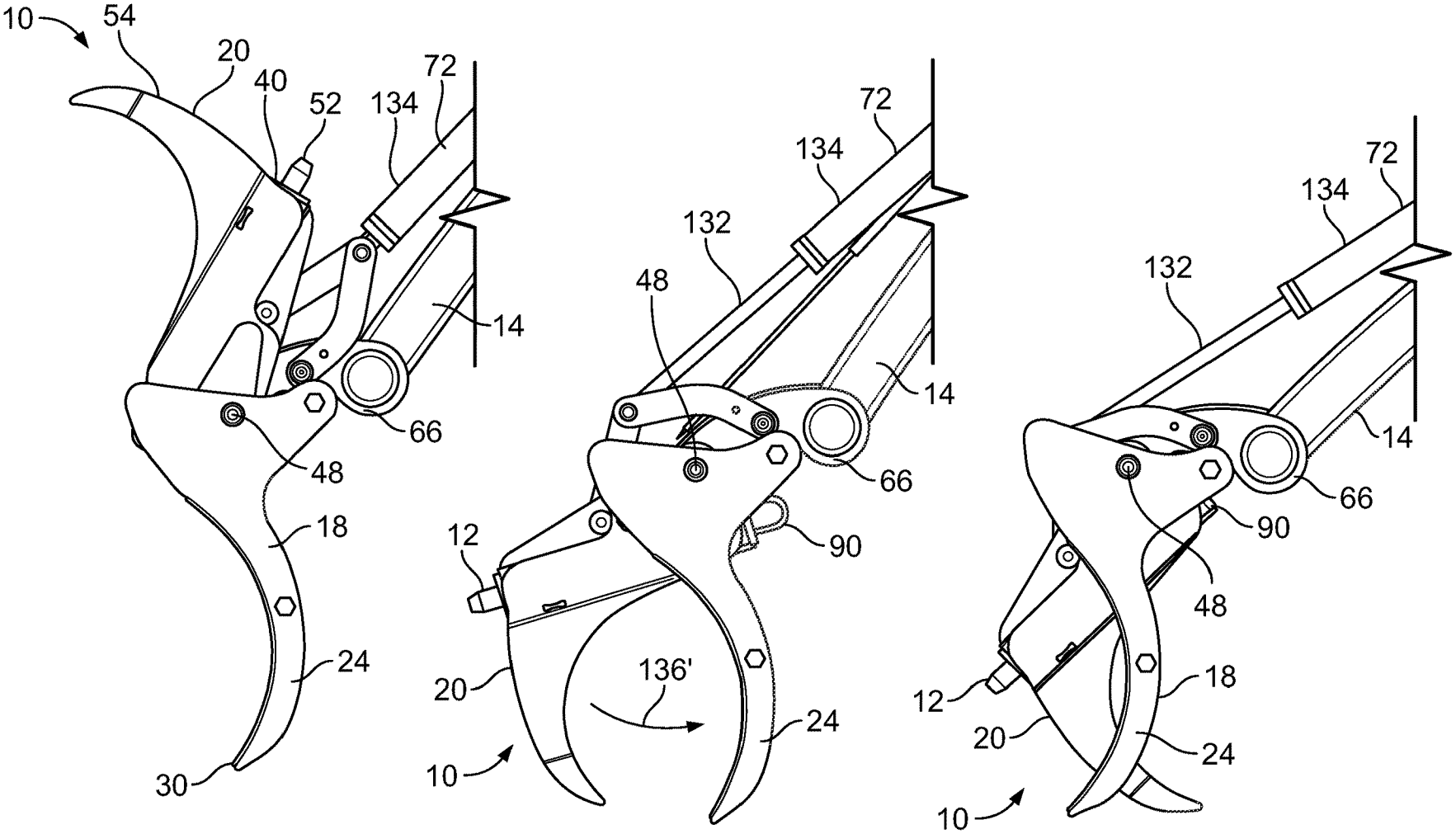
FIG. 6 illustrates a lateral view of a grappling assembly in a fully-opened position, according to an embodiment of the present disclosure.
FIG. 7 illustrates a lateral view of a grappling assembly in a closing position, according to an embodiment of the present disclosure.
FIG. 8 illustrates a lateral view of a grappling assembly in a fully-closed position, according to an embodiment of the present disclosure.

FIG. 6 illustrates a lateral view of the grappling assembly 10 in a fully-opened position, according to an embodiment of the present disclosure. As shown, the stop bar 100 (shown in FIG. 4) may be wedged against a rear surface of the coupler-connecting beam 66 of the moveable arm 14. The cylinder 72 may be in a fully retracted position in order to fully draw the upper claw 20 open about the pivot axis 48 with respect to the lower claw 18.

FIG. 7 illustrates a lateral view of the grappling assembly 10 in a closing position, according to an embodiment of the present disclosure. FIG. 8 illustrates a lateral view of the grappling assembly 10 in a fully-closed position, according to an embodiment of the present disclosure. Referring to FIGS. 7 and 8, the cylinder 72 extends in order to pivot the upper claw 20 toward the lower claw 18 about the pivot axis 48. The stop bar 100 (shown in FIGS. 4 and 5) of the lower claw 18 may be wedged against the moveable arm 14, thereby fixing the lower claw 18 in position. For example, the teeth 24 of the lower claw 18 may be dug into the ground, and the moveable arm 14 moved in order to wedge the lower claw 18 in place. Optionally, as the upper claw 20 rotates toward the lower claw 18, any structure between the upper claw 20 and the lower claw 18 will rotate the lower claw 18 toward the moveable arm 14 with increased rotation of the upper claw 20 into the structure in the direction of arc 136'. As the upper claw 20 continues to rotate, the upper claw 20 forces the structure into the lower claw 18 until the lower claw 18 wedges against the moveable arm 14, thereby preventing further rotation of the lower claw 18 in the direction of arc 136'. The upper claw 20 may continue to be pivoted in the direction of arc 136' about the pivot axis 48 until the structure is firmly compressed or otherwise grasped between the upper claw 20 and the lower claw 18, which is wedged against the moveable arm 14.

Figure 9:
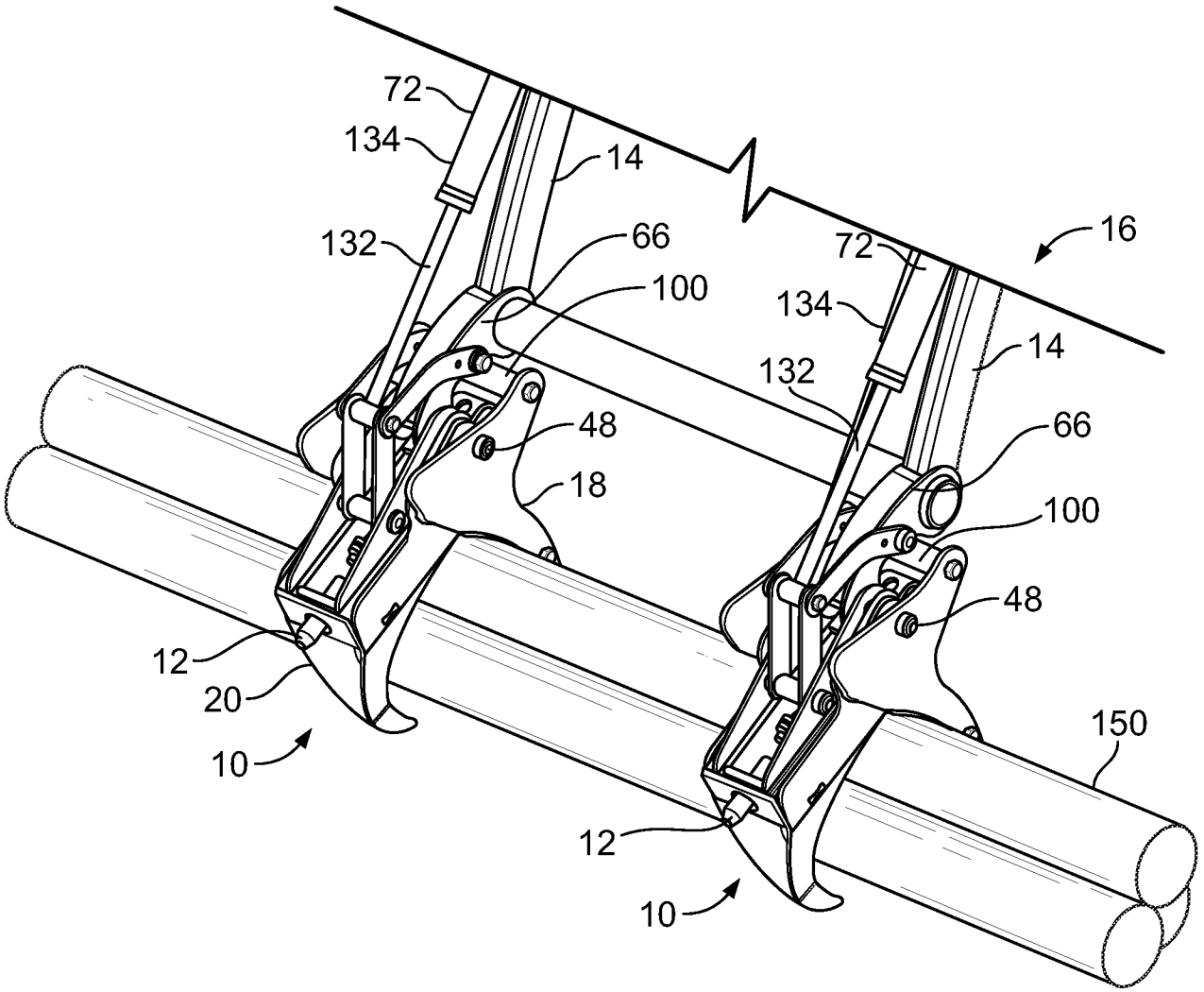
FIG. 9 illustrates a perspective top view of grappling assemblies securely grasping structures, according to an embodiment of the present disclosure.
Figure 10:
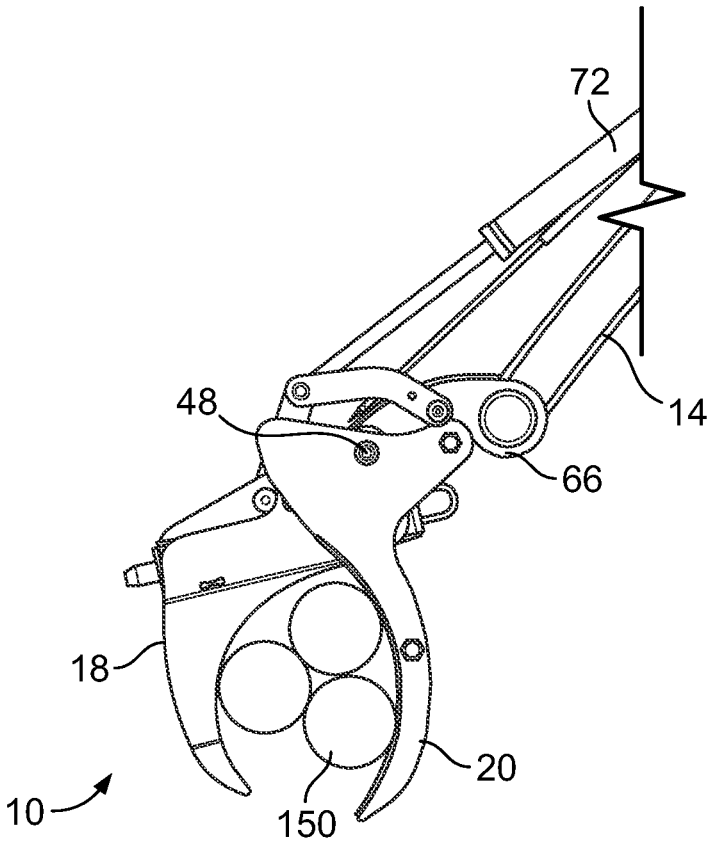
FIG. 10 illustrates a lateral view of a grappling assembly securely grasping structures, according to an embodiment of the present disclosure.

FIG. 9 illustrates a perspective top view of grappling assemblies 10 securely grasping structures 150, such as logs, tubes, beams, or the like, according to an embodiment of the present disclosure. FIG. 10 illustrates a lateral view of a grappling assembly 10 securely grasping the structures 150. Referring to FIGS. 9 and 10, the stop bars 100 of the lower claws 18 are securely wedged against rear surfaces of the moveable arms 14, such as the coupler-connecting beams 66. As such, the lower claws 18 are prevented from further pivoting toward the moveable arms 14, and the upper claws 18 may be pivoted about the pivot axes 48 to apply grasping force into the structures 150 in relation to the wedged lower claws 18. Accordingly, the structures 150 may be securely grasped by the grappling assemblies 10.

Referring to FIGS. 1-9, the couplers 12 may be separate and distinct components that are secured to the moveable arms 14. Alternatively, the couplers 12 may be integrally formed with the moveable arms 14. For example, the couplers 12 may be distal portions of the moveable arms 14 that are not configured to be separated therefrom. Also, alternatively, embodiments of the present disclosure may not include the couplers 12. Further, instead of being configured to be removably connected to the moveable arms 14, the grappling assemblies may be configured to permanently secure to the moveable arms 14.

Also, alternatively, the grappling assemblies may be configured to be removably connected to the moveable arms without the quick connect and disconnect method described above. For example, the grappling assemblies may be configured to connect to the moveable arms 14 and/or couplers 12 through separate and distinct fasteners, such as connecting pins, bushings, and the like.

Further, while linkages 75 are shown connecting the cylinders 72 to the couplers 12, embodiments of the present disclosure may not utilize such linkages 75. Instead, the cylinders 72 may directly connect to portions of the couplers 12 or directly to end of the moveable arms 14.

Figure 11:
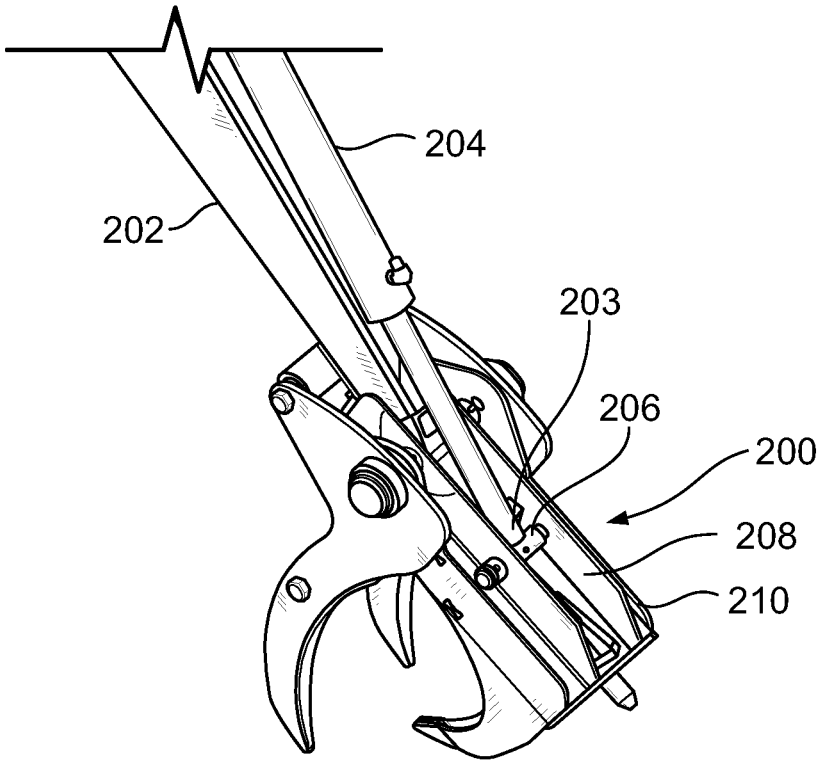
FIG. 11 illustrates a perspective top view of a grappling assembly secured to a moveable arm, according to an embodiment of the present disclosure.
Figure 12:
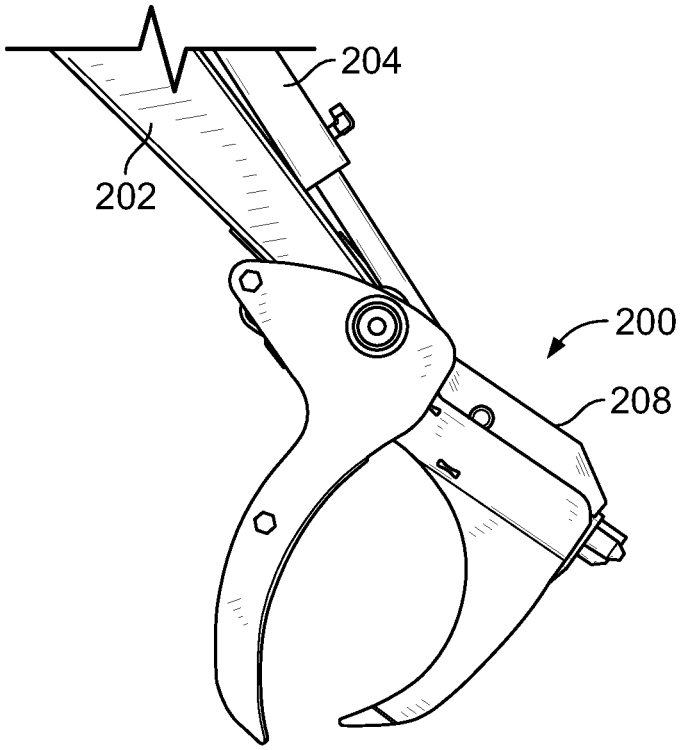
FIG. 12 illustrates a lateral view of a grappling assembly secured to a moveable arm, according to an embodiment of the present disclosure.

FIG. 11 illustrates a perspective top view of a grappling assembly 200 secured to a moveable arm 202, according to an embodiment of the present disclosure. FIG. 12 illustrates a lateral view of the grappling assembly 200 secured to the moveable arm 202. Referring to FIGS. 11 and 12, the grappling assembly 200 is similar to those described above, except that a distal extension end 203 of a cylinder 204 directly connects to a pivot pin 206 within a rear wall 208 of an upper claw 210. As such, the grappling assembly 200 may not connect to the moveable arm through a linkage, such as shown in FIG. 1.

Figure 13:
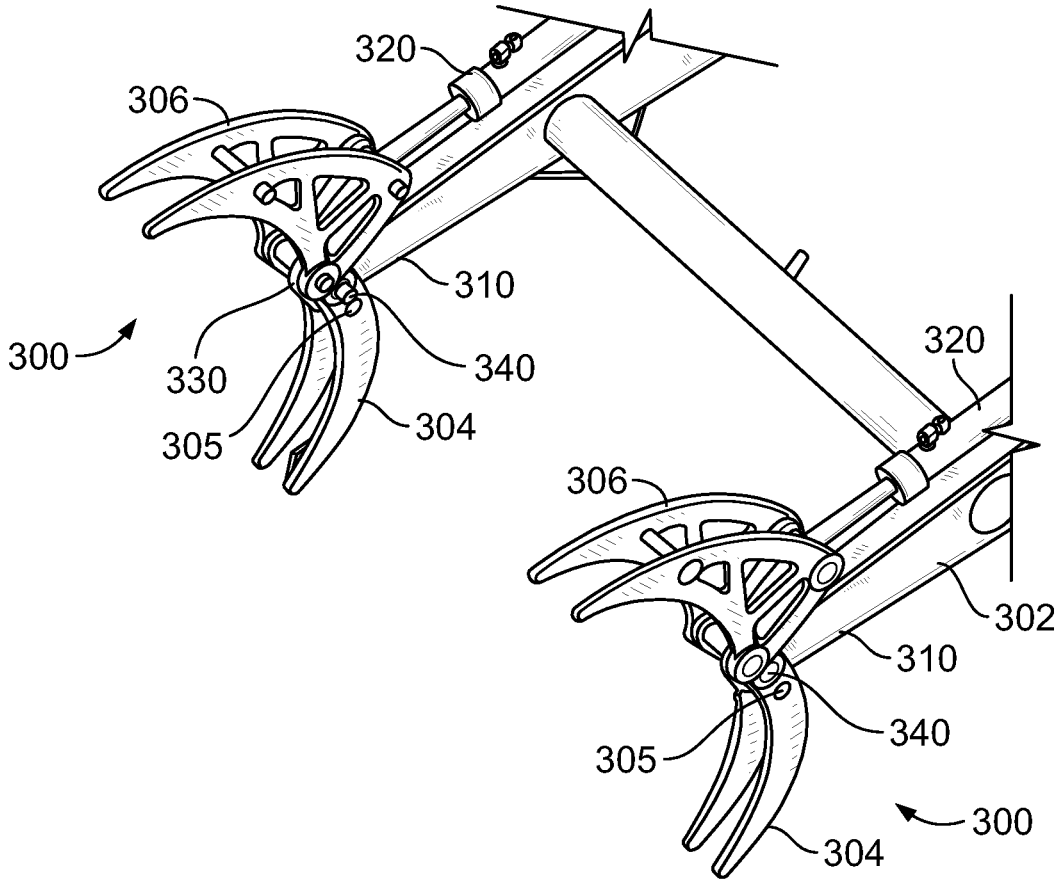
FIG. 13 illustrates a perspective top view of grappling assemblies secured to moveable arms, according to an embodiment of the present disclosure.
Figure 14A:
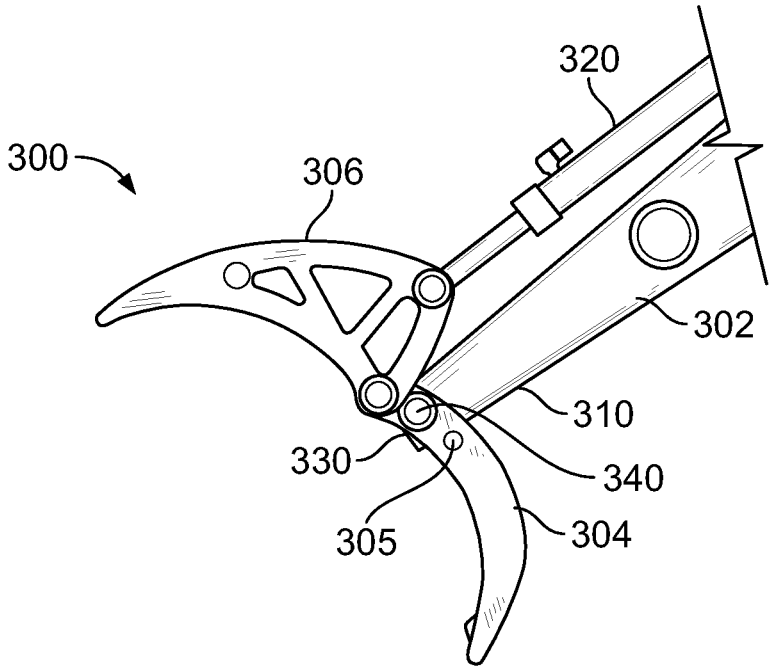
FIG. 14*a* illustrates a lateral view of a grappling assembly secured to a moveable arm, according to an embodiment of the present disclosure.

FIG. 13 illustrates a perspective top view of grappling assemblies 300 secured to moveable arms 302, according to an embodiment of the present disclosure. FIG. **14*a* illustrates a lateral view of the grappling assembly 300 secured to the moveable arm 302. Referring to FIGS. 13 and 14, the grappling assembly 300 may include a lower claw 304 and an upper claw 306. The lower claw 304 may include a stop bar 305 configured to wedge against a rear surface 310 of the moveable arm 302, as described above. The upper claw 306 may be operatively connected to an actuating cylinder 320 in order to pivot the upper claw 306 between open and closed positions, as described above. The upper claw 306 may be pivotally secured to the lower claw 304. Optionally, both the upper claw 306 and the lower claw 304 may be separately pivotally secured to a distal end 330 of the moveable arm 302**.

The grappling assembly 300 may be pivotally secured to the distal end 330 of the moveable arm 302 through a connecting pin 340. For example, one or more connecting pins 340 may pivotally secure the upper and lower claws 306 and 304, respectively, to the distal end 330 of the moveable arm 302. In this manner, in order to securely connect the grappling assembly 300 to the moveable arm 302, an operator may need to manipulate the grappling assembly 300 and the connecting pin(s) 340 with his/her hands.

As shown, the grappling assembly 300 may directly connect to the moveable arm 302. Thus, a separate and distinct coupler may not be used to connect the grappling assembly 300 to the moveable arm 302.

Figure 14B:
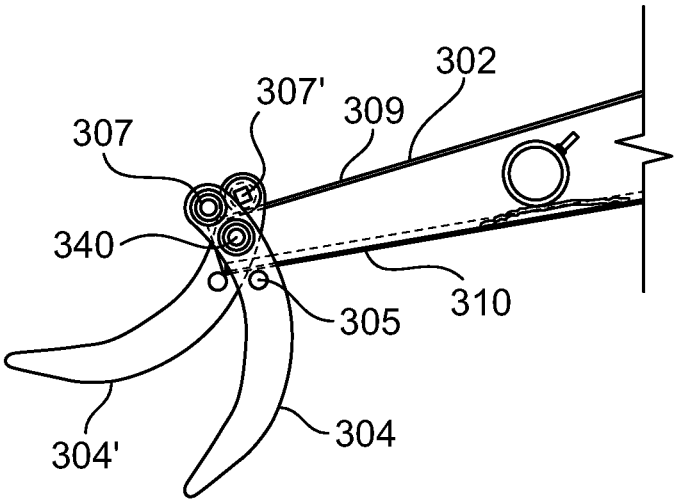
FIG. 14*b* illustrates a lateral view of a lower claw pivotally secured to a moveable arm, according to an embodiment of the present disclosure.

FIG. 14*b* illustrates a lateral view of the lower claw 304 pivotally secured to the moveable arm 302, according to an embodiment of the present disclosure. The lower claw 304 is shown in a fully-opened position, and a fully closed position 304'. In the fully-open position, the stop bar 305 abuts against the rear surface 310 of the moveable arm 302, thereby preventing further rotation of the lower claw 304 towards the rear surface 310. In the fully-closed position, a top stop 307' abuts against an upper surface 309 of the moveable arm, thereby preventing movement of the lower claw 304 towards the upper surface 309.

As noted above, the configuration and orientations may be reversed, such that the lower claw 304 is operatively connected to an actuating cylinder, while the upper claw 306 is not connected to an actuating cylinder.

Figure 15:
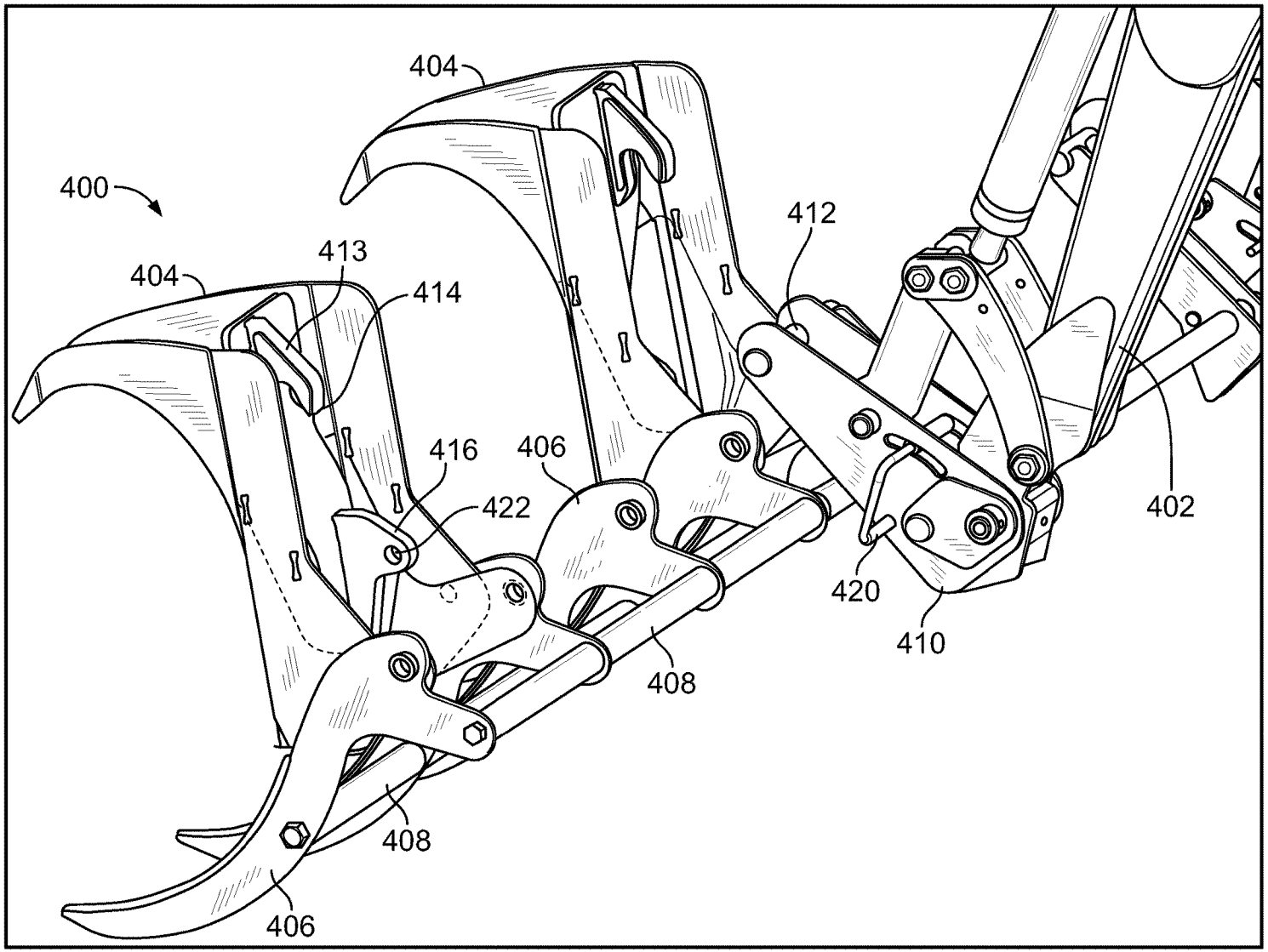
FIG. 15 illustrates a perspective rear view of a grappling assembly disconnected from a moveable arm, according to an embodiment of the present disclosure.

FIG. 15 illustrates a perspective rear view of a grappling assembly 400 disconnected from a moveable arm 402, according to an embodiment of the present disclosure. The grappling assembly 400 may include two spaced upper claws 404, each of which is connected to a lower claw 406. The lower claws 406 may be connected by one or more connection beams 408 disposed between multiple lower claw members 406 that are not connected below upper claws 404. The connected lower claw members 406 may be connected to form a unitary structure, such as a rake, for example. Any of the embodiments described above may include a unitary lower claw structure, as shown in FIG. 15. Alternatively, the upper claws 404 may be connected by connecting beams and additional upper claws to form a grab fork, for example. As a further alternative, the grappling assembly 400 may include a lower rake like structure, as shown in FIG. 15, and a similar upper claw structure.

The moveable arm 402 is connected to a coupler 410. The coupler includes an upper pivot pin 412 that is configured to operatively hook onto a latch member 413 of the upper claw 404. The latch member 413 may include a lower channel 414 into which the pivot pin 412 is configured to be retained. A lower latch member 416 may be configured to operatively connect to an actuating pin (hidden from view) within the coupler 410. For example, opposed connecting pins 420 may be actuated or otherwise moved into a channel 422 formed through the lower latch member 416. Accordingly, the grappling assembly 400 may be configured to be quickly and easily connected and disconnected from the moveable arm 402 without the use of separate and distinct fasteners.

Figure 16:
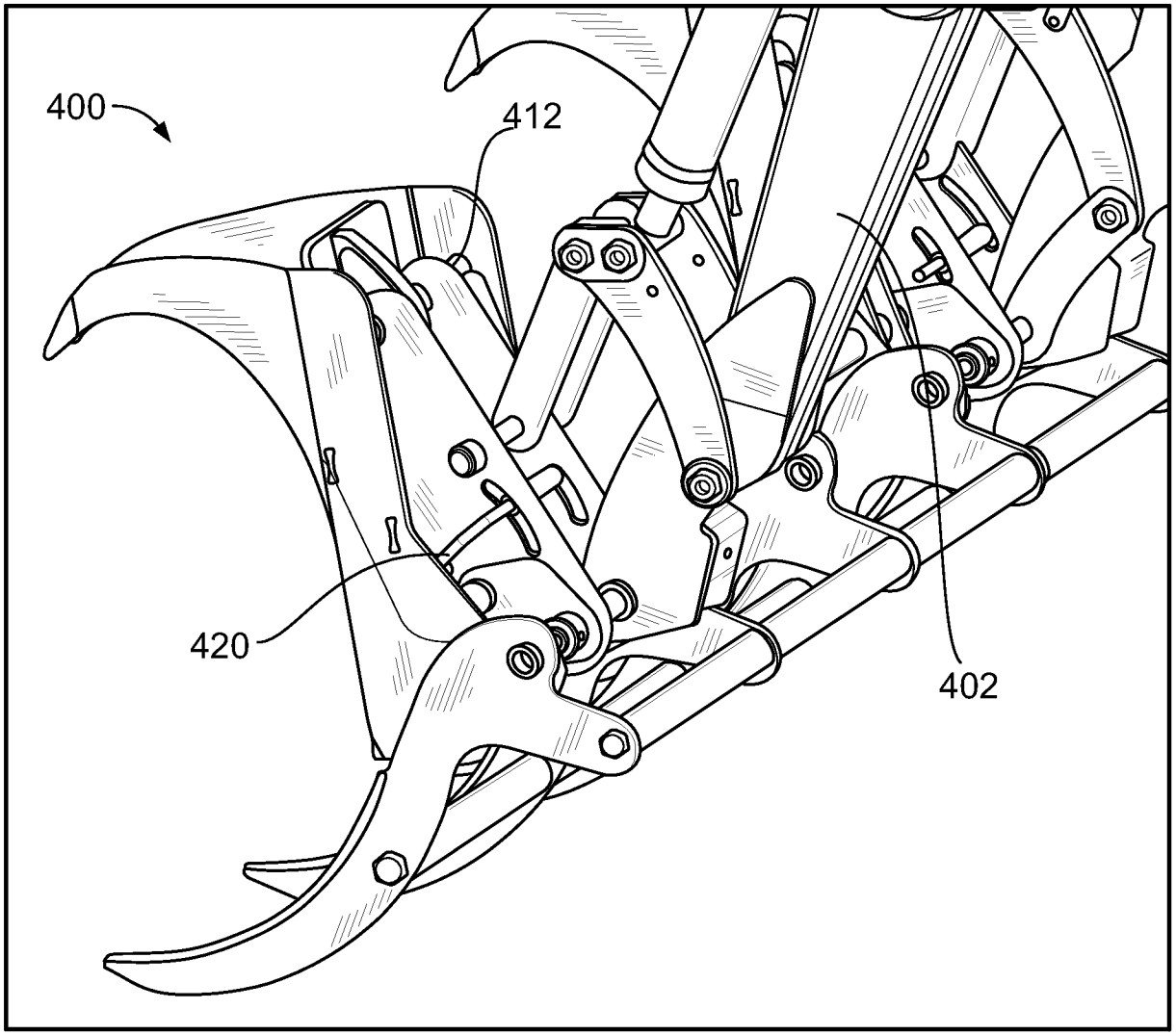
FIG. 16 illustrates a perspective rear view of a grappling assembly connected to a moveable arm, according to an embodiment of the present disclosure.

FIG. 16 illustrates a perspective rear view of the grappling assembly 400 connected to the moveable arm 402, according to an embodiment of the present disclosure. As shown, the coupler 410 pivotally connects to the latch member 413 and/or the latch member 416 (hidden from view in FIG. 15).

Figure 17:
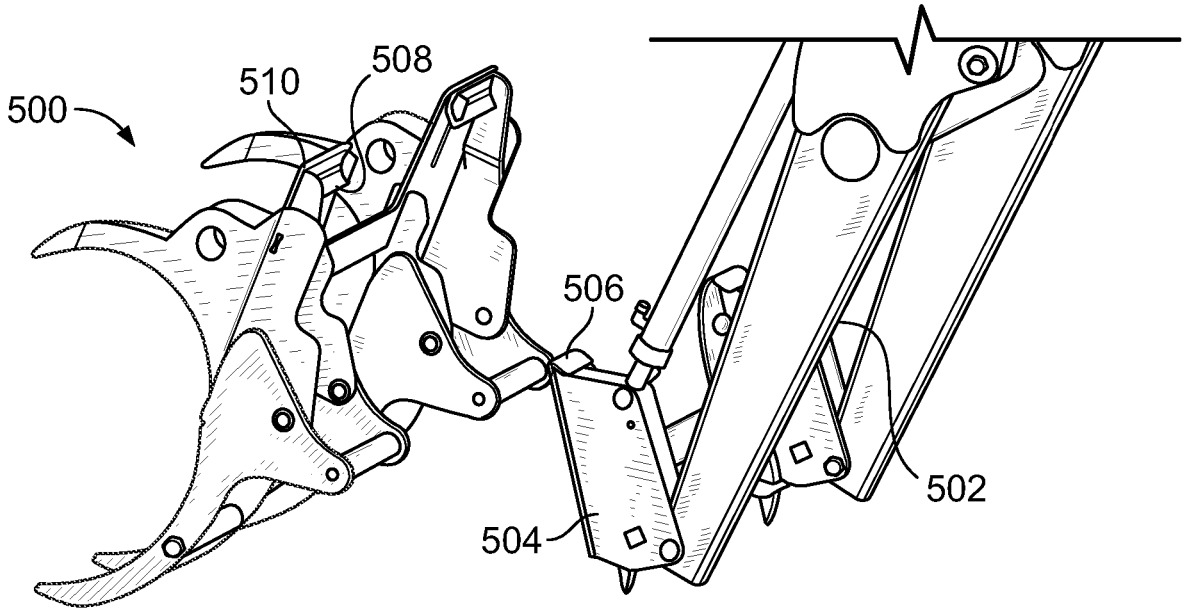
FIG. 17 illustrates a perspective rear view of a grappling assembly disconnected from a moveable arm, according to an embodiment of the present disclosure.

FIG. 17 illustrates a perspective rear view of a grappling assembly 500 disconnected from a moveable arm 502, according to an embodiment of the present disclosure. The grappling assembly 500 may be similar to any of those described above. A coupler 504 is pivotally secured to an end of the moveable arm 502. The coupler 504 includes a ramped upper portion 506 and a lower protuberance 507. The ramped upper portion 506 is configured to engage a reciprocal bracket 508 at a top portion of an upper claw 510, while the lower protuberance 507 is configured to mate into a lower reciprocal bracket of the upper claw 510.

Figure 18:
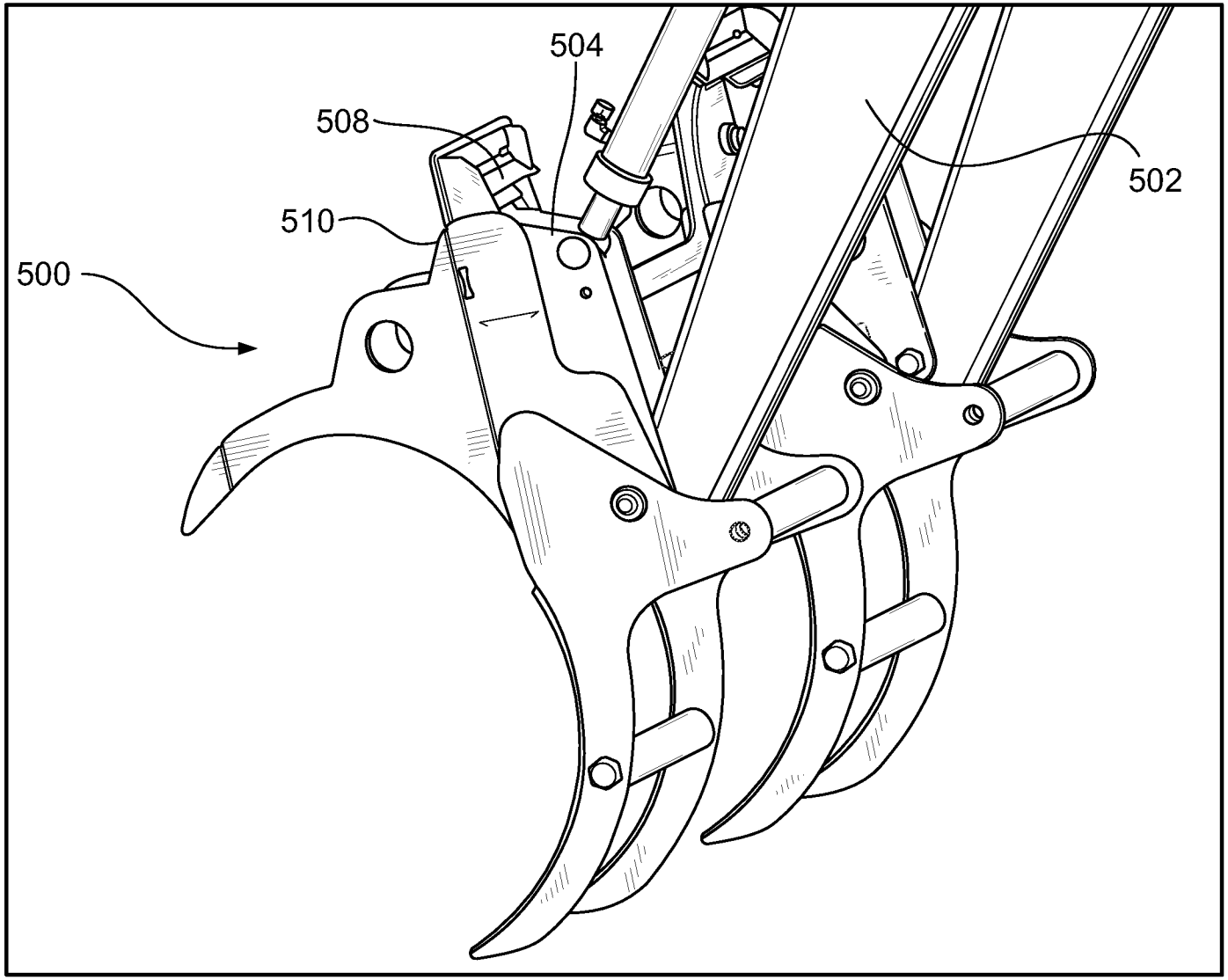
FIG. 18 illustrates a perspective rear view of a grappling assembly connected to a moveable arm, according to an embodiment of the present disclosure.

FIG. 18 illustrates a perspective rear view of the grappling assembly 500 connected to the moveable arm 502, according to an embodiment of the present disclosure. As shown, the coupler 504 removably connects to the upper claw 510 by way of the ramped upper portion 506 connecting to the reciprocal bracket 508, and the lower protuberance 507 (hidden from view) connecting to the lower reciprocal bracket.

It is to be understood that embodiments of the present disclosure may be configured and modified to attach and detach from various types of couplers, other than those shown. For example, the coupler 504 may be sized and shaped differently than shown, and the grappling assemblies described in the present application may be sized and shaped to be attached and detached from such a coupler.

Figure 19:
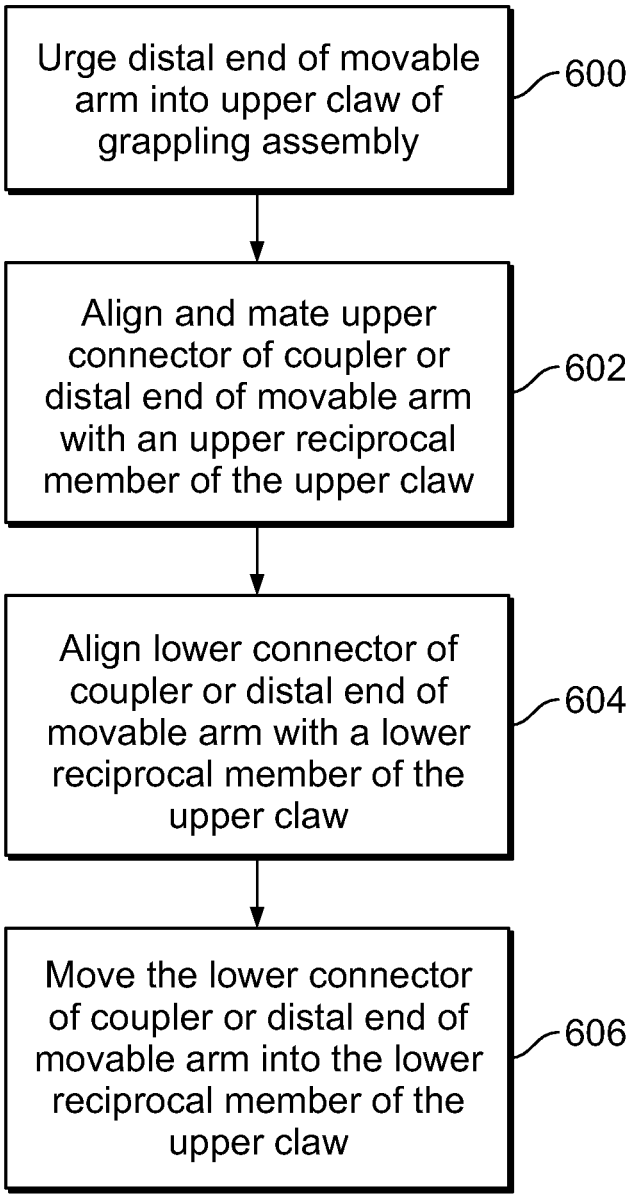
FIG. 19 illustrates a flow chart of a method of attaching a grappling assembly to a moveable arm, according to an embodiment of the present disclosure.

FIG. 19 illustrates a flow chart of a method of attaching a grappling assembly to a moveable arm, according to an embodiment of the present disclosure. At 600, a distal end of a moveable arm is urged into an upper claw of a grappling assembly. For example, an operator may control machinery to move the moveable arm into the upper claw.

Next, at 602, an upper connector of a coupler or distal end of the moveable arm is aligned and mated with an upper reciprocal member of the upper claw. For example, an upper stud of a coupler may be mated into a reciprocal opening formed through an upper wall of a main housing of the upper claw.

Then, at 604, a lower connector of the coupler or distal end of the moveable arm is aligned with a lower reciprocal member of the upper claw. For example, a connecting peg of the coupler may be aligned with a peg-connecting member of the upper claw. The components may be aligned by operation of the moveable arm, for example.

Once aligned, the lower connector of the coupler is moved into the lower reciprocal member of the upper claw at 606. For example, the lower connector may be a hydraulically-actuated pin that is actuated into the lower reciprocal member.

Figure 20:
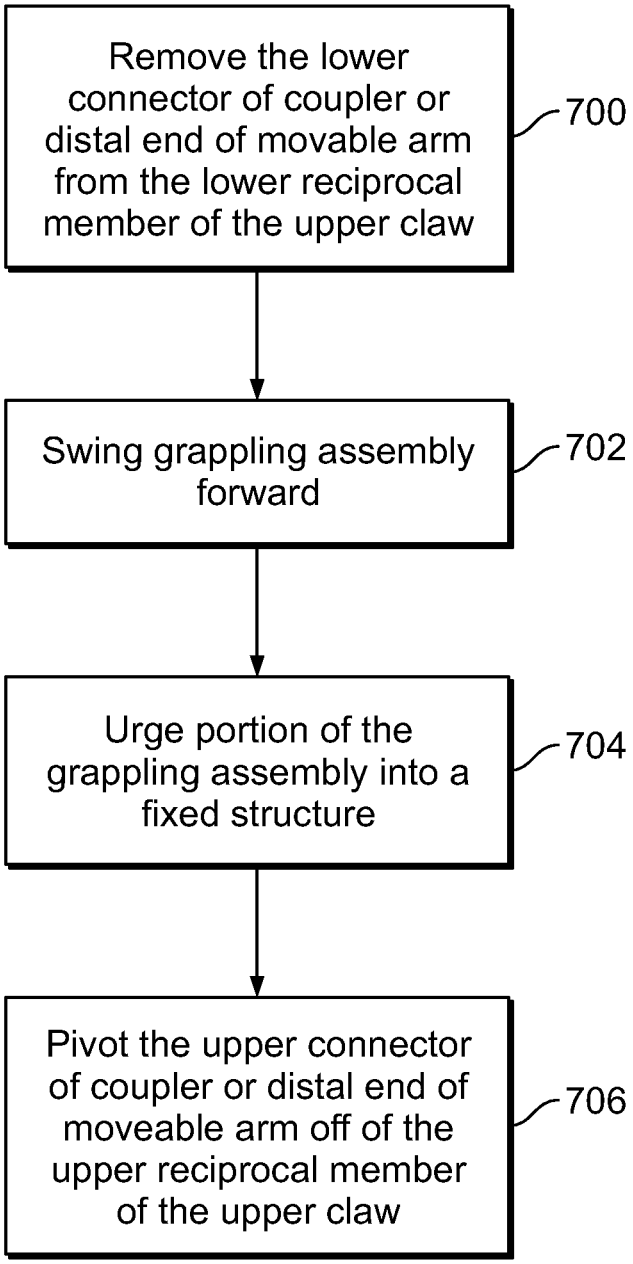
FIG. 20 illustrates a flow chart of a method of removing a grappling assembly from a moveable arm, according to an embodiment of the present disclosure.

FIG. 20 illustrates a flow chart of a method of removing a grappling assembly from a moveable arm, according to an embodiment of the present disclosure. At 700, the lower connector of the coupler or distal end of the moveable arm is removed from the lower reciprocal member of the upper claw. Then, at 702, the grappling assembly may be swung forward, pivoting about the connection between the upper connector of the coupler or moveable arm and the reciprocal member of the upper claw. The center of gravity of the upper claw may automatically swing the grappling assembly forward in such a manner.

Then, at 704, at least a portion of the grappling assembly may be urged into a fixed structure, such as the ground, in order to provide leverage with respect to the grappling assembly. While urged into the fixed structure, at 706 the moveable arm may then be moved to pivot the upper connector of the coupler of distal end of the moveable arm off of the upper reciprocal member of the upper claw. Optionally, the grappling assembly may not be urged into a fixed structure, such as the ground, but instead may be wedged into a portion of a moveable arm of a loader, for example.

Figure 21:
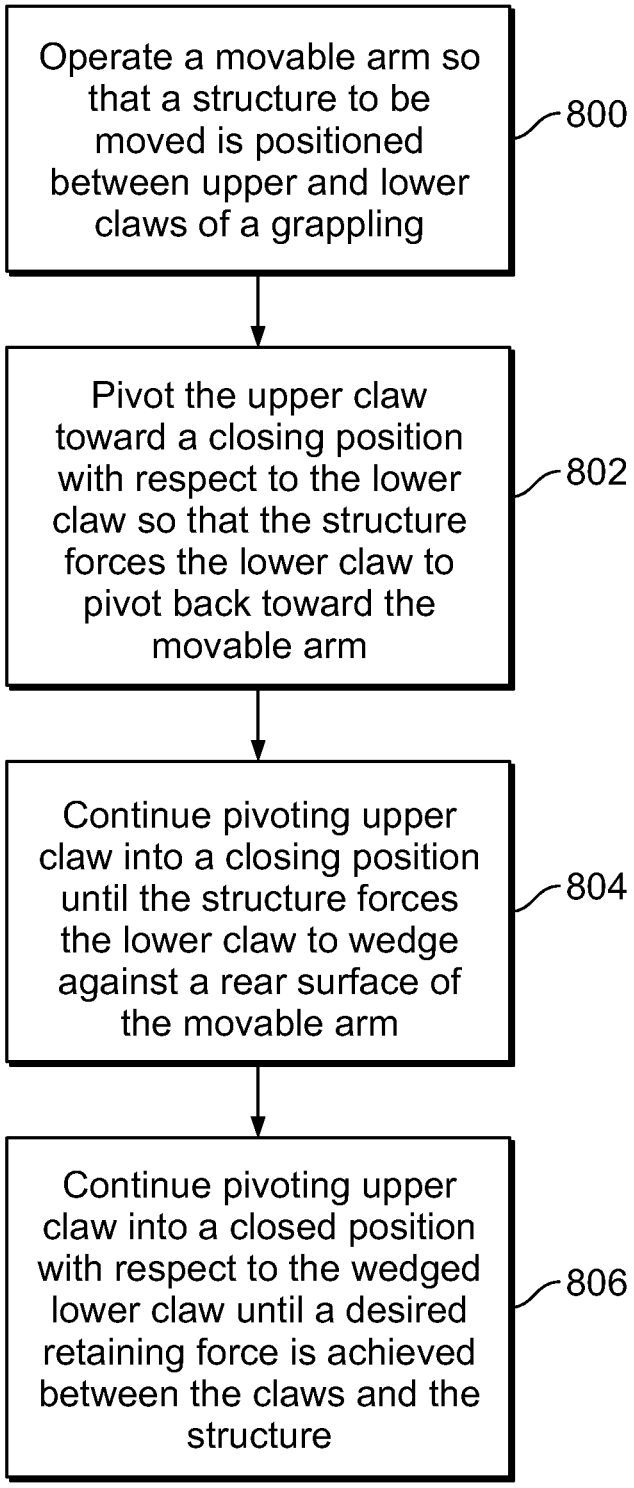
FIG. 21 illustrates a flow chart of grasping a structure with a grappling assembly, according to an embodiment of the present disclosure.

FIG. 21 illustrates a flow chart of grasping a structure with a grappling assembly, according to an embodiment of the present disclosure. At 800, a moveable arm is operated so that a structure to be moved is positioned between upper and lower claws of a grappling assembly. Then, at 802, an upper claw of the grappling assembly is pivoted toward a closing position with respect to a lower claw so that the structure forces the lower claw to pivot back toward the moveable arm. At 804, the upper claw continues to be pivoted into a closing position until the structure, which is being moved by the upper claw, forces the lower claw to wedge against a rear surface of the moveable arm. Then, at 806, the upper claw continues to be pivoted into a closed position with respect to the wedged lower claw until a desired retaining force is achieved between the claws and the structure.

Referring to FIGS. 1-21, embodiments of the present disclosure provide a grappling assembly that may be configured to grasp one or more structures through only a single actuating cylinder. For example, only a single actuating cylinder connected to an upper claw may be used to pivot the upper claw toward the lower claw. The lower claw may wedge up against the moveable arm, thereby providing leverage with respect to the closing upper claw. As such, embodiments of the present disclosure provide a more efficient, cost-effective grappling assembly in comparison to many known grapplers.

Certain embodiments of the present disclosure provide a grappling assembly having one or more stops (which may move or "float" as the grappling assembly moves) that allows the grappling assembly to quickly and easily connect to a coupler, for example, without the need for an operator to manipulate the grappling assembly with his/her hands. The stop(s) may be sized and shaped so that it is wide enough to be universally used with various couplers. As such, the stop(s) may be sized and shaped to not interfere with bucket stops that some loaders have welded to loader arm ends, for example. Further, the stop(s) may eliminate the need to connect additional linkage to the grappling assembly that would other connect opposed claws.

Certain embodiments of the present disclosure provide grappling assemblies that may be universally used with various other couplers and quick-connecting systems and methods than those shown. While certain examples of couplers and quick connecting systems and methods are shown, it is to be understood that embodiments of the present disclosure may be used with numerous other couplers and systems.

Moreover, embodiments of the present disclosure provide grappling assemblies that may be larger or smaller than shown. The grappling assemblies may be sized and shaped based on the size and stability of the device, vehicle, or the like to which they are to be attached.

Embodiments of the present disclosure provide grappling assemblies that provide an operator with the benefit of grasping, grabbing, or the like with claws, as described above, that may be driven by hydraulic power as found on a typical loader for example. As such, embodiments of the present disclosure may use the existing structure of a loader, for example, instead of requiring additional hydraulics, plumbing, and the like.

Additionally, certain embodiments of the present disclosure provide a system and method for hands-free attachment and detachment of a grappling assembly to a loader, for example. As such, an operator is not required to handle and manipulate the grappling assembly in order to secure it to a loader, for example. Accordingly, the operator is spared the labor and mess that would otherwise arise when hooking up separate hydraulics and the like to the grappling assembly and/or the loader, for example.

As noted above, while various embodiments describe an upper claw operatively connected to an actuating cylinder, such as through a coupler, while the lower claw is not connected to an actuating cylinder, it is to be understood that such a configuration may be reversed. For example, a lower claw may be operatively connected to an actuating cylinder extending below a moveable arm, while the upper claw may not be connected to an actuating cylinder.

As noted above, the upper claw may pivotally connect to the lower claw at a pivot axis. The pivot axis may be completely aligned with a pivot axis on a coupler or a distal end of a moveable arm. Optionally, the pivot axis may be aligned in an offset manner with respect to the pivot axis of the coupler or the distal end of the moveable arm. For example, the pivot axis of the grappling assembly may be offset between 1-15 degrees with respect to the pivot axis of the coupler or the moveable arm. Optionally, the offset angle may exceed 15 degrees. Also, for example, the pivot axis of the grappling assembly may be offset from the pivot axis of the coupler within a radius, such as a 10" radius. Alternatively, the radius may be greater or less than 10". In this manner, the pivot axis of the grappling assembly may be substantially axially aligned within a pivot radius of an arm pivot axis of a moveable arm, for example. The claws may be connected within a radius area of the pivot point of the loader arm end, for example.

Additionally, embodiments of the present disclosure provide grappling assemblies that include a stop, such as a stop bar, that is configured to be wedged into a portion of the moveable arm to provide a leverage point. The stop, which may swing forward when force is not applied to the lower claw, for example, provides a resistive leverage point, thereby allowing the upper claw to pinch or otherwise close with respect to the lower claw.

Unlike known grapplers, embodiments of the present disclosure do not require a complicated or elaborate linkage between the moveable arm and the grappling assembly. Certain embodiments of the present disclosure do not require additional bushings, sleeves, and/or pins to connect to couplers or distal ends of moveable arms. Further, embodiments of the present disclosure provide grappling assemblies that may be operated through the use of a single actuating cylinder operatively connected to only one of two pivotal grasping claws.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §

112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A utility system comprising:

at least one moveable arm;

a coupler pivotally connected to a distal end of the moveable arm, the coupler including an outwardly-extending stud extending from a first end, a connecting peg located at a second end that is opposite the first end, the connecting peg being moveable by an actuator to and from an extended position in which the connecting peg extends outwardly from the second end of the coupler from and to a retracted position in which the connecting peg is retracted within the second end of the coupler; and a grappling assembly configured to connect to the at least one moveable arm of a utility component, wherein the grappling assembly comprises:

an upper claw including:

a main housing having a coupling opening formed through a first end, and a peg-retaining member located at a second end that is opposite the first end, wherein the coupling opening is configured to removably receive the outwardly-extending stud of the coupler connected to a first portion of the at least one moveable arm, wherein the peg-retaining member is configured to removably receive the connecting peg of the coupler in response to the connecting peg being actuated into the extended position, the coupler and the main housing being fixed to one another when the stud is received in the coupling opening and the extended connecting peg is received in the peg-retaining member; and one or more first grasping teeth extending from the main housing, the one or more first grasping teeth each having a first grasping surface; and a lower claw including one or more second grasping teeth each having a second grasping surface, wherein the lower claw is secured to the upper claw through a pivotal connection, the pivotal connection including one or more pivoting connections having a single pivot axis, wherein the grappling assembly is devoid of any additional linkages between the upper and lower claws, wherein the upper claw is configured to close with respect to the lower claw, wherein the lower claw is configured to be forced into physical engagement with at least a portion of the moveable arm so that motion of the lower claw away from the upper claw is limited by the portion of the moveable arm so that the upper claw is configured to compressively grasp a structure between the one or more first grasping teeth and the one or more second grasping teeth;

wherein the lower claw is configured to be able to move away from the at least the portion of the moveable arm without the upper claw detaching from the coupler.

2. The utility system of claim 1, wherein the grappling assembly is configured to be removably attached to and detached from the at least one moveable arm without the use of a separate and distinct fastener.

3. The utility system of claim 1, wherein the main housing includes one or more latch members configured to securely latch onto reciprocal features of the coupler or a distal end of the moveable arm.

4. The utility system of claim 1, wherein the pivot axis is configured to be substantially axially aligned within a pivot radius of an arm pivot axis of the moveable arm or the coupler.

5. The utility system of claim 1, wherein one or both of the lower and upper claws include connecting beams connecting multiple claw members together.

6. A grappling assembly configured to connect to a moveable arm of a utility component, wherein the grappling assembly comprises:

a first claw including:

a main housing having a coupling opening formed through a first end, and a peg-retaining member located at a second end that is opposite the first end, wherein the coupling opening is configured to removably receive an outwardly-extending stud of a coupler connected to a first portion of the moveable arm, wherein the peg-retaining member is configured to removably receive a connecting peg of the coupler in response to the connecting peg being actuated into an extended position, the coupler and the main housing being fixed to one another when the stud is received in the coupling opening and the extended connecting peg is received in the peg-retaining member; and one or more first grasping teeth extending from the main housing, the one or more first grasping teeth each having a first grasping surface; and a second claw including one or more second grasping teeth each having a second grasping surface, wherein the second claw is secured to the first claw through a pivotal connection, the pivotal connection including one or more pivoting connections having a single pivot axis, wherein the grappling assembly is devoid of any additional linkages between the first and second claws, wherein the first claw is configured to close with respect to the second claw, wherein the second claw is configured to be forced into physical engagement with at least a portion of the moveable arm so that motion of the second claw away from the first claw is limited by the portion of the moveable arm so that the first claw is configured to compressively grasp a structure between the one or more first grasping teeth and the one or more second grasping teeth;

wherein the second claw is configured to be able to move away from the at least the portion of the moveable arm into a non-wedged position without the first claw detaching from the coupler.

7. The grappling assembly of claim 6, wherein the grappling assembly is configured to be removably attached to and detached from the moveable arm without the use of a separate and distinct fastener.

8. The grappling assembly of claim 6, wherein the main housing includes one or more latch members configured to securely latch onto reciprocal features of the coupler or a distal end of the moveable arm.

9. The grappling assembly of claim 6, wherein the pivot axis is configured to be substantially axially aligned within a pivot radius of an arm pivot axis of the moveable arm or the coupler.

10. The grappling assembly of claim 6, wherein one or both of the first and second claws includes connecting beams connecting multiple claw members together.

11. The grappling assembly of claim 6, wherein the first claw is one of an upper or lower claw, and wherein the second claw is the other of the upper or lower claw.

* * * * *